United States Patent [19]

Moss

[11] Patent Number: 4,576,603

[45] Date of Patent: Mar. 18, 1986

[54] FEEDING DEVICE FOR ENTERALLY ADMINISTERING LIQUIDS INTO A HUMAN BODY

[76] Inventor: Gerald Moss, R.D. #1, West Sand Lake, N.Y. 12196

[21] Appl. No.: 621,675

[22] Filed: Jun. 18, 1984

[51] Int. Cl.[4] ..... A61J 7/00

[52] U.S. Cl. ..... 604/410; 604/246

[58] Field of Search ..... 604/410, 408, 403, 248, 604/246, 247

[56] References Cited

U.S. PATENT DOCUMENTS

| | | | |
|---|---|---|---|
| 2,766,907 | 10/1956 | Wallace, Jr. | 604/410 |
| 3,911,918 | 10/1975 | Turner | 604/410 |
| 4,326,526 | 4/1982 | Buck et al. | 604/410 X |
| 4,396,382 | 8/1983 | Goldhaber | 604/410 |

*Primary Examiner*—John D. Yasko

*Attorney, Agent, or Firm*—Schmeiser & Morelle

[57] ABSTRACT

A feeding device for the enteral introduction of nourishment to a human patient which device is comprised of three sheets of inextensible material sealed together to form four independent compartments. The top two compartments which are larger form a reservoir for the feeding solution and a container for coolant in order to preserve the feeding solution over extended periods of time. A tube leading from the reservoir travels through a four way valve wherein the solution is directed to either of two feeding chambers which have a common dividing wall formed by the dividing sheet of material. The dividing wall is flaccid so as to be able to contact and conform to either of the outer sheets. The four way valve serves to alternate the flow of solution from the reservoir to one of the chambers while opening the flow from the other chamber to the patient. A simple clamping means allows for the determination of the amount of solution which can be introduced into the feeding chambers thereby determining the volume of the bolus of nourishment being provided to the patient.

4 Claims, 3 Drawing Figures

FEEDING DEVICE FOR ENTERALLY ADMINISTERING LIQUIDS INTO A HUMAN BODY

FIELD OF THE INVENTION

This invention relates generally to devices which are used in the medical field in order to administer liquid nourishment directly to a patient's digestive tract. More specifically, this invention relates to such a feeding apparatus having a main reservoir which alternately fills two feeding chambers from which the liquid is administered to the patient by gravity.

BACKGROUND AND SUMMARY OF THE INVENTION

Often, as a result of various medical procedures or certain types of illness, it becomes impossible for a patient to ingest nourishment orally. In many such situations, it becomes necessary to administer nourishment directly to the digestive tract, either at a site in the stomach or directly into the proximal segment of the small bowel. For example, recent studies indicate that post operatively, patients can maintain much of their own healing abilities if they receive ample nourishment shortly after the operation. Since oral feeding is often not possible, the use of a suitable feeding apparatus becomes essential for a quick recovery.

Devices used to administer nourishment enterally must meet several criteria in order to be effective. The device should be easy to operate to assure proper use by individuals unfamiliar with the device or even by the patient himself. Nevertheless, though simple to operate, the device must also be able to accurately dispense a predetermined amount of liquid and have safety features in order to avoid overfeeding.

Among the first feeding devices were plastic bags, similar to those used in plasma and blood transfusions. With these devices, the rate of flow was adjusted by varying the height of the feeding unit above the patient and by adjusting a constricting device attached to the tubing leading to the patient. One drawback of using this device was the inability to accurately determine the amount of nourishment being administered during a set period of time and the resultant need to frequently monitor the delivery. In addition, since there was direct communication between the bag and the patient, there was always the threat of overfeeding. If bags with only a small volume were used, overfeeding could be avoided but the need to frequently replace empty feeding units would again be very time consuming.

In response to these shortcomings, a variety of feeding type devices were developed. The complexity of these devices increased to a point where operation by untrained or inexperienced individuals was almost impossible. Many of these devices used liquids or gases in order to pressurize the fluids being administered, thereby seeking to obtain greater degrees of accuracy in measuring the amount of nourishment provided over a given period of time. Other devices utilized complex electrical or electromechanical means in order to measure and pump the liquids into the patient. By increasing the complexity of these devices, there has also been a concomitant increase in the risks of error, either from actual failures of the devices or mistakes by personnel responsible for operating the devices.

There is presently a need for a simple yet effective feeding unit, which although being easy to use, also incorporates the necessary safeguards against overfeeding. This is especially true since in some situations, a patient may return home while still receiving nourishment through either a jejunostomy feeding tube, a long-term nasogastric tube, or a similar apparatus. Providing a simple yet effective feeding unit not only allows the patient to safely treat himself at home, but also removes much of the anxiety which comes from the patient or family member operating relatively complex equipment.

Since these individuals are seeking to return to a more normal lifestyle, it is also preferable for them to self-administer their nourishment in a manner which mimics normal eating patterns as much as possible. Thus, devices which provide small quantities of nourishment at a constant rate over an extended period of time are undesirable. For these situations, it is preferable to mimic normal feeding patterns by administering a bolus of food in a relatively short period of time and then allowing the body to go through its normal digestion and absorption processes.

Another factor which needed to be taken into consideration was that of cost. Not only would reducing the cost of a feeding unit broadly benefit the medical industry by reducing medical costs, but it would also aid the individual patient without proper insurance coverage. In order to develop a simple, yet effective, feeding device, I began with an analysis of the basic plastic bag type feeding device. My object was to overcome the previously mentioned shortcomings without significantly complicating the basic device. I also sought to retain the advantages of the basic bag structure. These devices were easy to use and were inexpensive enough to be disposable which is important for maintaining sterile conditions. When I finally divided the bag by adding a center sheet of material, I began to appreciate the possibilities in having a multichambered unitary device. Shortly thereafter, I developed the subject invention.

It is, therefore, an object of this invention to provide a feeding unit capable of delivering predetermined amounts of nourishment accurately.

It is another object of this invention to provide a feeding unit which can be effectively operated by untrained personnel and only requires a minimal amount of attention.

Another object of this invention is to provide a feeding unit having safeguards against overfeeding.

Another object of this invention is to provide a device in which the amount of liquid to be administered at one time can easily by varied.

Another object is to provide an invention which is capable of delivering the nourishment as a bolus within a relatively short period of time.

Another object of this invention is to provide a device wherein the speed of delivery of the bolus from one of the feeding chambers to the patient is independent of the flow rate from a reservoir into the adjacent feeding chamber.

Briefly, the present invention accomplishes the above purposes by providing a unitary structure consisting of three sheets of inextensible material. These sheets are sealed so as to form four compartments, two of which are larger and are used as a reservoir and as a coolant container, and the other two of which are used as alternate feeding chambers. The divider between the feeding chambers acts as a common wall and is sufficiently flaccid so as to allow either of the chambers to have a maximum value which is equal to the maximum combined value of both chambers. A control means alternates the flow of fluid to and from the chambers so that while the fluid in one chamber is flowing to the patient, fluid from the feeding solution reservoir is flowing into the other chamber.

DETAILED DESCRIPTION OF THE INVENTION

Figure 1:
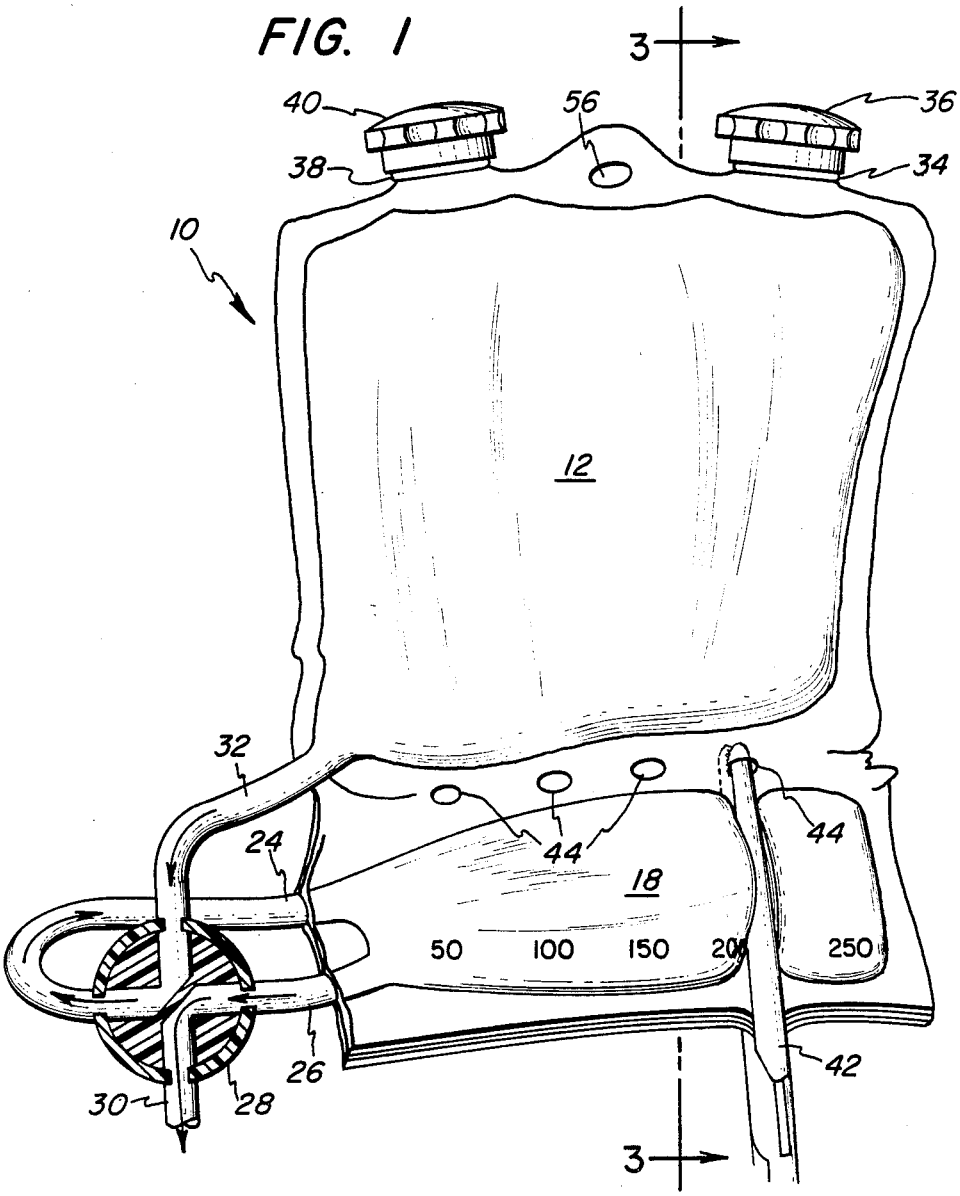
FIG. 1 is an elevational view of the feeding unit showing the reservoir, one feeding chamber and the four way valve in one of its delivery modes.
Figure 3:
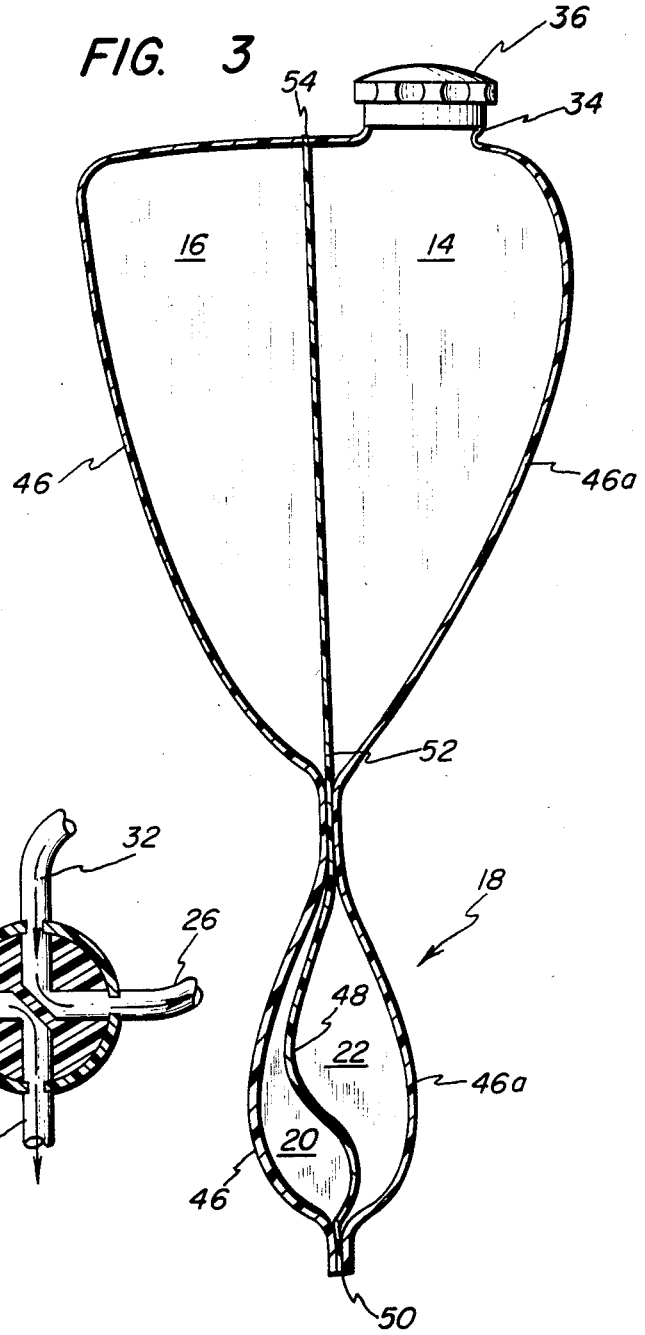
FIG. 3 is a cross sectional view taken along lines 3—3 of FIG. 1 showing the unitary three layer construction of the device.

FIG. 1 of the present invention discloses the feeding device generally designated as 10. The feeding device 10 has an upper feeding solution holding portion 12 which, as shown in FIG. 3, is divided into a feeding solution reservoir 14 and a coolant container 16. Any one of a number of appropriate coolants can be introduced into the coolant container and thereby preserve the feeding solution in the reservoir. The lower portion of the device 10 is the feeding solution delivery portion 18 which as shown in FIG. 3 is divided into a first feeding chamber 20 and a second feeding chamber 22.

A first passageway 24 alternates as an inlet and an outlet to the first feeding chamber 20 and a second passageway 26 serves alternately as an inlet and an outlet to the second feeding chamber 22.

A four way valve 28 controls the direction of flow from the reservoir to the first or second passageway and from the first or second feeding chamber through delivery outlet 30 which travels to the patient.

As shown in FIG. 1, the feeding solution from the reservoir travels from the reservoir through a tube 32 into the four way valve 28. In the position shown in FIG. 1, the solution travels from the reservoir through the four way valve into the first passageway 24 and into the first feeding chamber. Meanwhile, the solution in the second feeding chamber travels from that chamber through the second passageway 26 into the four way valve 28 where it is directed to the delivery outlet 30 which travels to the patient.

Figure 2:
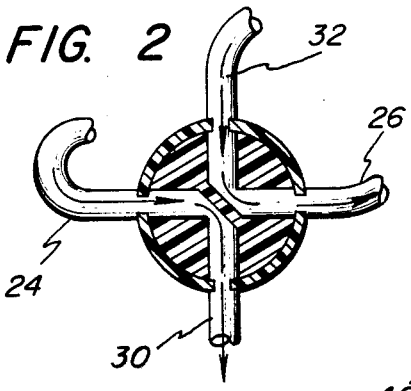
FIG. 2 is a diagrammatic showing the four way valve in its other delivery mode.

FIG. 2 shows the alternate delivery mode of the four way valve 28. In this mode, the feeding solution from the reservoir 14 enters the four way valve through tube 32 but is instead directed through the second passageway 26 and into the second feeding chamber 22. Simultaneously, the feeding solution contained in the first feeding chamber 20 travels through the first passageway 24 to the four way valve 28 wherein it is directed through the delivery outlet 30 to the patient.

The feeding solution reservoir is filled by the introduction of liquid through the reservoir inlet 34 which is covered by a reservoir cap 36. The coolant container 16 is filled through the coolant inlet 38 which is covered by the coolant cap 40. For safety purposes, it is preferable that these caps are color coded and coordinated with the inlets or in some way marked so as to further guard against error.

As also shown in FIG. 1, the feeding solution's delivery portion has volumetric markings which can be used to determine the amount of liquid within the delivery portion. A clamp 42 can be inserted through holes which are placed between the feeding solution holding portion 12 and the feeding solution delivery portion 18. These holes correspond with the volumetric markings so that the clamp can be used to seal off portions of the feeding chambers in order to vary the amount of solution being delivery to the patient during a given interval.

As shown in FIG. 3, the feeding device 10 is comprised of three inextensible sheets of material. Any suitable material such as plastic is suitable for this use. These materials are bunched and sealed at certain points in order to obtain the configuration shown in FIG. 3. While various methods of sealing are appropriate, clearly the use of standard heat sealing methods could be easily applied to this product.

Referring to the delivery portion 18, the three sheets, namely the outer sheets 46 and 46A and the inner dividing sheet 48 are all of substantially equal length between the first seal 50 and the second seal 52. This causes the dividing sheet 48 to be flaccid so that it can come in contact with and conform to either outer sheet 46 or 46A. This allows the total volume of either the first or second feeding chamber to be equal to the total possible volume for the entire delivery portion 18.

In the solution holding portion 12, the outer sheets 46 and 46A are substantially equal in length. Thus, the volume in the coolant container 16 has a minimal effect on the total volume capability of the feeding solution reservoir 14. This serves to facilitate filling of the reservoir and the container without the need to perform measurements. The upper portion of sheets 46, 46A and 48 are connected at the third seal 54 which can also be fashioned with an eyelet 56 as shown in FIG. 1.

In operation, the feeding solution is introduced into the feeding solution reservoir 14 through reservoir inlet 34. If the feeding solution is going to be maintained in the reservoir for an extended period of time, an appropriate coolant is introduced into the coolant container 16 through coolant inlet 38. The four way valve 28 is then turned, connecting the reservoir to one of the feeding chambers. For this description, we will assume that the first feeding chamber is initially filled with the feeding solution. Thus, the feeding solution travels from the reservoir through tube 32 to the four way valve 28 wherein it is directed through the first passageway 24 to the first feeding chamber 20. The volume entering the first feeding chamber is determined by the placement of clamp 42 around the feeding solution delivery portion 18. When filled, the dividing sheet 48 will be in contact with and conform to outer sheet 46A so that volumetrically, the second feeding chamber 22 is virtually nonexistent. At this point, the four way valve 28 is rotated to a position as shown in FIG. 2. This alternates the flow such that the feeding solution in the first feeding chamber now travels to the four way valve and is directed to the delivery outlet 30 which proceeds to the patient. Simultaneously, the feeding solution in the reservoir 14 is now directed through the second passageway 26 into the second feeding chamber 22. It will be appreciated that due to the fact that the outer sheet 46 and the dividing sheet 48 are independently collapsible, the rate of flow from the first feeding chamber 20 is not dependent upon the rate of flow from the reservoir to the second feeding chamber 22. Similarly, it will also be appreciated that by fashioning the dividing sheet 48 and the outer sheets 46 and 46A from an inextensible material, the volume of feeding solution in the feeding chambers can be accurately determined through the volumetric markings on the outer portion of the chambers.

While the above comprises the preferred embodiment of this invention, the scope of this invention is meant to be limited only by the appended claims since numerous variations are possible without departing from the essence of this device.

What is claimed:

1. A device for the enteral introduction of liquids into a human body comprising:

a reservoir;

an inextensible, collapsible feeding container communicating with said reservoir, said feeding container being variable in volume between an expanded state containing a predetermined maximum volume and a contracted state wherein said container is substantially empty;

an inextensible divider separating the feeding container into two substantially equal chambers, said divider being sufficiently flaccid to conform to the opposite wall of either chamber such that the maximum volume of either chamber is substantially equal to the maximum volume of the container in its expanded state, each chamber having a passageway for the introduction and expulsion of liquids; and a flow alternating means connected between the reservoir and the chambers for selectively directing the liquid flow from the reservoir to one of the chambers while simultaneously directing the flow from the other chamber to the patient.

2. The invention of claim 1 further comprising:

means for selectively varying the maximum volume of the container in its expanded state.

3. The invention of claim 2 wherein said device is formed by three separate sheets of material sealed together to form a three layered unitary structure defining said reservoir, said feeding containers and a coolant container adjacent to said reservoir for refrigerating the feeding solution in the reservoir.

4. The invention of claim 3 wherein the center sheet forming the common wall between the reservoir and the coolant container is shorter than the outer sheets for said reservoir and coolant container.

* * * * *